US007614623B2

(12) United States Patent
Johnston

(10) Patent No.: US 7,614,623 B2
(45) Date of Patent: Nov. 10, 2009

(54) HEAD-TO-HEAD TILTING SURFACE GAME

(76) Inventor: Steve Johnston, 30 McConiga, Lyle, WA (US) 98635

( * ) Notice: Subject to any disclaimer, the term of this patent is extended or adjusted under 35 U.S.C. 154(b) by 238 days.

(21) Appl. No.: 11/864,683

(22) Filed: Sep. 28, 2007

(65) Prior Publication Data

US 2009/0085285 A1 Apr. 2, 2009

(51) Int. Cl.
*A63F 7/00* (2006.01)

(52) U.S. Cl. ..... 273/110; 273/113

(58) Field of Classification Search ..... 273/108–11, 273/113, 115, 116, 118 R, 118 A, 123 R, 273/123 A
See application file for complete search history.

(56) References Cited

U.S. PATENT DOCUMENTS

| | | | | | |
|---|---|---|---|---|---|
| 2,083,119 | A | | 6/1937 | Hense | |
| 2,562,126 | A | * | 7/1951 | Rishel | 273/110 |
| D169,672 | S | * | 5/1953 | Hopkins | D21/338 |
| 2,846,226 | A | | 8/1958 | Reynolds | |
| 3,479,033 | A | | 11/1969 | Crisafulli | |
| 3,539,188 | A | | 11/1970 | Salverda | |
| 3,643,952 | A | * | 2/1972 | Sprowl | 273/110 |
| 3,787,055 | A | * | 1/1974 | Kraemer | 273/110 |
| 3,815,917 | A | | 6/1974 | Brown | |
| 3,841,636 | A | * | 10/1974 | Meyer | 273/110 |
| 3,931,972 | A | * | 1/1976 | Fabian | 273/110 |
| 3,967,824 | A | * | 7/1976 | Lund | 273/110 |
| 4,089,526 | A | * | 5/1978 | Olving | 273/110 |
| 4,094,507 | A | * | 6/1978 | Kauffmann | 273/110 |
| 4,216,963 | A | | 8/1980 | Boucher | |
| 4,257,600 | A | | 3/1981 | Goldfarb | |
| 4,325,551 | A | | 4/1982 | Kulesza | |
| 4,448,416 | A | | 5/1984 | Belter | |
| 5,042,808 | A | * | 8/1991 | Shoptaugh | 273/110 |
| 5,607,155 | A | | 3/1997 | Campbell | |
| 5,749,575 | A | * | 5/1998 | German | 273/113 |
| 7,543,818 | B2 | * | 6/2009 | Borg | 273/110 |
| 2009/0085285 | A1 | * | 4/2009 | Johnston | 273/110 |

FOREIGN PATENT DOCUMENTS

| | | |
|---|---|---|
| GB | 2016933 | 10/1979 |

* cited by examiner

*Primary Examiner*—Raleigh W. Chiu
(74) *Attorney, Agent, or Firm*—Marger Johnson & McCollom, P.C.

(57) ABSTRACT

A head-to-head tilting surface game, comprising a playing surface tiltable along two orthogonal axes and configured to support moving playing pieces thereon and having a goal area. Each of a first pair of controls is disposed adjacent opposite peripheral edges of the playing surface along a first of the two orthogonal axes. Each of the first pair of controls is independently actuatable to result in a respective move signal. A first mixer is coupled between the first pair of controls and tilting surface to combine move signals from respective controls into a first axis tilt response and impart said first axis tilt response to the playing surface, whereby the playing pieces supported on the playing surface move responsive to the first axis tilt response imparted to the playing surface so that the playing pieces can be moved toward the goal area.

29 Claims, 10 Drawing Sheets

| SCENARIO | PLAYER #1 TURN | 1st VECTOR MOVE SIGNAL | PLAYER #2 TURN | 2nd VECTOR MOVE SIGNAL | SUM | TILT |
|---|---|---|---|---|---|---|
| 1 | ↻ ↺ | ⇧ | — | — | ⇧ | |
| 2 | ↺ | ⇦ | ↻ | ⇦ | ⇧ | |
| 3 | ↻ | ⇧ | ↻ | ⇨ | ∅ | |
| 4 | ↺ | ⇦ | ↺ ↻ | ⇨ | ⇨ | |
FIG.3
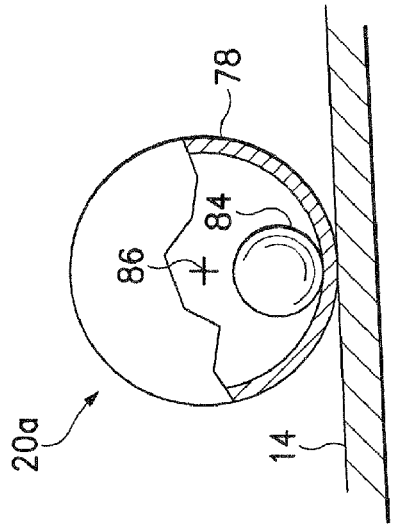
FIG.4B
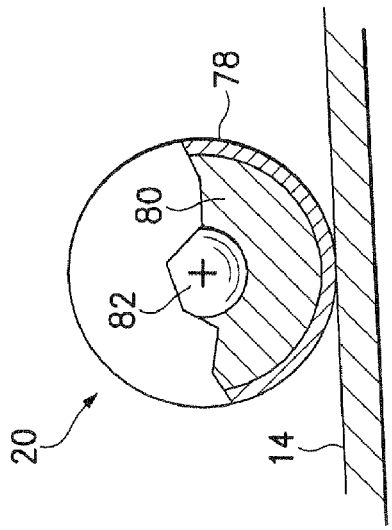
FIG.4A

HEAD-TO-HEAD TILTING SURFACE GAME

BACKGROUND OF THE INVENTION

This invention relates generally to a game apparatus, and more particularly to an improved game having a playing surface that may be tilted by opposing players to direct movement of playing pieces toward a goal area.

Many games have been developed in which a player uses actuators to tilt a playing surface so that a ball or other rolling object moves along a surface and under the influence of gravity to a goal position. One of the most recognizable examples of this is a tilting maze where a player must move a marble through the maze by tilting the maze surface in two orthogonal dimensions.

The problem becomes a little more complicated when the game is intended for head-to-head play by opposing players. One example of such a system is shown in U.S. Pat. No. 5,607,155 to Campbell in which four handles attached at spaced peripheral edges of the centrally-pivoted table are used by players to physically tilt the table in various directions. A drawback to the Campbell system, however, is that success depends in large part to the comparative strength of the players. That is, enjoyment of the game is severely reduced if the opposing players have mismatched strength.

Other head-to-head tilting games have been developed which raise or lower corners of table. Examples of these include U.S. Pat. No. 3,479,033 to Crisafulli, and U.S. Pat. No. 3,539,188 to Salverda. In Crisafulli, each player can rotate their two cammed handles to engage with the underside of the table surface and thereby raise that portion of the table. In Salverda, each player can push down upon two handles to lower the particular corners of the playing surface biased upward by springs. Drawbacks to these games are that the lifting and lowering of the playing surface may not be smooth and thus cause the playing pieces to bounce; furthermore, certain tilting actuators may be taken out of play, thus reducing enjoyment of the game.

Accordingly, the need arises for a game having improved controls for overcoming the drawbacks of these prior art games.

SUMMARY OF THE INVENTION

The invention comprises a slightly bowl-shaped playing surface that angles downward from a peripheral edge of the circular playing surface to a centrally located hole. Weighted balls are ejected on to the playing surface during play. In head-to-head action, the object of the game is to steer one's own weighted balls into the hole, with the person having steered all of their balls in being the winner.

Steering occurs by way of one or more sets of controls, with each set adapted to tilt the playing surface on one axis. Each control set would include a control actuated by a first player and a control actuated by a second player. Input from the controls are coupled in a mechanical or electrical mixer and thence transmitted to the playing surface to effect tilting.

In a preferred embodiment, the controls to effect mixing of the player actuation. signals includes two sets of pulleys located beneath a gimbled playing surface. Four rotatable dials are spaced about the periphery of the game. One pair of opposed dials acts upon the first pulley system and associated gamble pivots to tilt the surface along a first axis. A second pair of opposed dials acts upon a second set of pulleys and gimbals to tilt the playing surface along a second axis, perpendicular to the first. Each of the two sets of pulleys and gimbals acts independently of the other, thus allowing one or more players to tilt the playing field in any direction.

An important feature of the invention is the ability to allow both offensive and defensive tilting. The system of pulleys and gimbals are interconnected so that one player can tilt up while another player is trying to tilt the surface downward—thus resulting in no tilt. Tilting occurs along axes, thus ensuring better balance of the game. Furthermore, turning one dial has no effect on the movement of the other dial, thus ensuring that strength plays no part in the game.

The specific arrangement of pulleys and gimbals is as follows. Each of the dials turns an associated central pulley wrapped by a cord. Secondary pulleys on either side of the central pulley guide the cord to the tilting pulleys located more centrally along the underside of the playing surface. Turning the handle one way causes the cord on one side of the central pulley to lengthen, thus allowing that side of the surface to rise upward. Consequently, the cord on the other side is shortened and therefore pulls the central tilting pulley downward. The tilting pulleys are each spaced equally about a central axis of the playing surface so that the height is maintained.

The invention comprises several general embodiments for implementing the inventive apparatus and method. In a first general embodiment, a head-to-head tilting surface game comprises a playing surface tiltable in two orthogonal directions to effect movement of playing pieces toward a goal area located on the playing surface. A first set of controls are coupled together and configured to tilt the playing surface along a first of the two orthogonal directions. A second set of controls are coupled together and configured to tilt the playing surface along a second of the two orthogonal directions. Players of the game can then actuate one of the first set of controls and one of the second set of controls to effect tilting of the playing surface in competition with an opposing player operating another of the first set of controls and another of the second set of controls.

In a second general embodiment, the head-to-head tilting surface game comprises a playing surface tiltable along two orthogonal axes and configured to support moving playing pieces thereon and having a goal area. Each of a first pair of controls is disposed adjacent opposite peripheral edges of the playing surface along a first of the two orthogonal axes. Each of the first pair of controls is independently actuatable to result in a respective move signal. A first mixer is coupled between the first pair of controls and tilting surface to combine move signals from respective controls into a first axis tilt response and impart said first axis tilt response to the playing surface, whereby the playing pieces supported on the playing surface move responsive to the first axis tilt response imparted to the playing surface so that the playing pieces can be moved toward the goal area.

In a third general embodiment, a game comprises a playing surface over which one or more generally spherical elements are adapted to roll. A raised peripheral edge is bounding said playing surface and includes a central zone within the playing surface as a goal to which the spherical elements are adapted to be guided during play of the game. A first set of two opposing actuators in common communication with a first mixer are configured to tilt the playing surface along a first axis passing through a center of the playing surface. A second set of two opposing actuators are in common communication with a second mixer, independent of the first mixer, and is configured to tilt the playing surface along a second axis passing through a center of the playing surface, said second axis being orthogonal to the first. Each of the actuators can be used to oppose tilting caused by an opposing actuator within the same set.

In a fourth general embodiment, a method for tilting the playing surface of a game to influence movement of playing pieces on the playing surface comprises placing moveable playing pieces on a playing surface, receiving movement from a first actuator resulting in a first vector move signal, and receiving movement from a second actuator resulting in a second vector move signal The first and second vectors are summed through a mixing unit and tilting movement is imparted to the playing surface in a magnitude proportional to the summation of the first and second vectors.

The foregoing and other objects, features and advantages of the invention will become more readily apparent from the following detailed description of a preferred embodiment of the invention that proceeds with reference to the accompanying drawings.

BRIEF DESCRIPTION OF THE DRAWINGS

FIG. 3 is a table showing exemplary player inputs and tilting signal outputs using the tilting mechanism of FIG. 2.

FIGS. 4A and 4B are partial cutaway view of the balls used as playing pieces in the game of FIG. 1 according to alternate embodiments of the invention.

DETAILED DESCRIPTION

Figure 1:
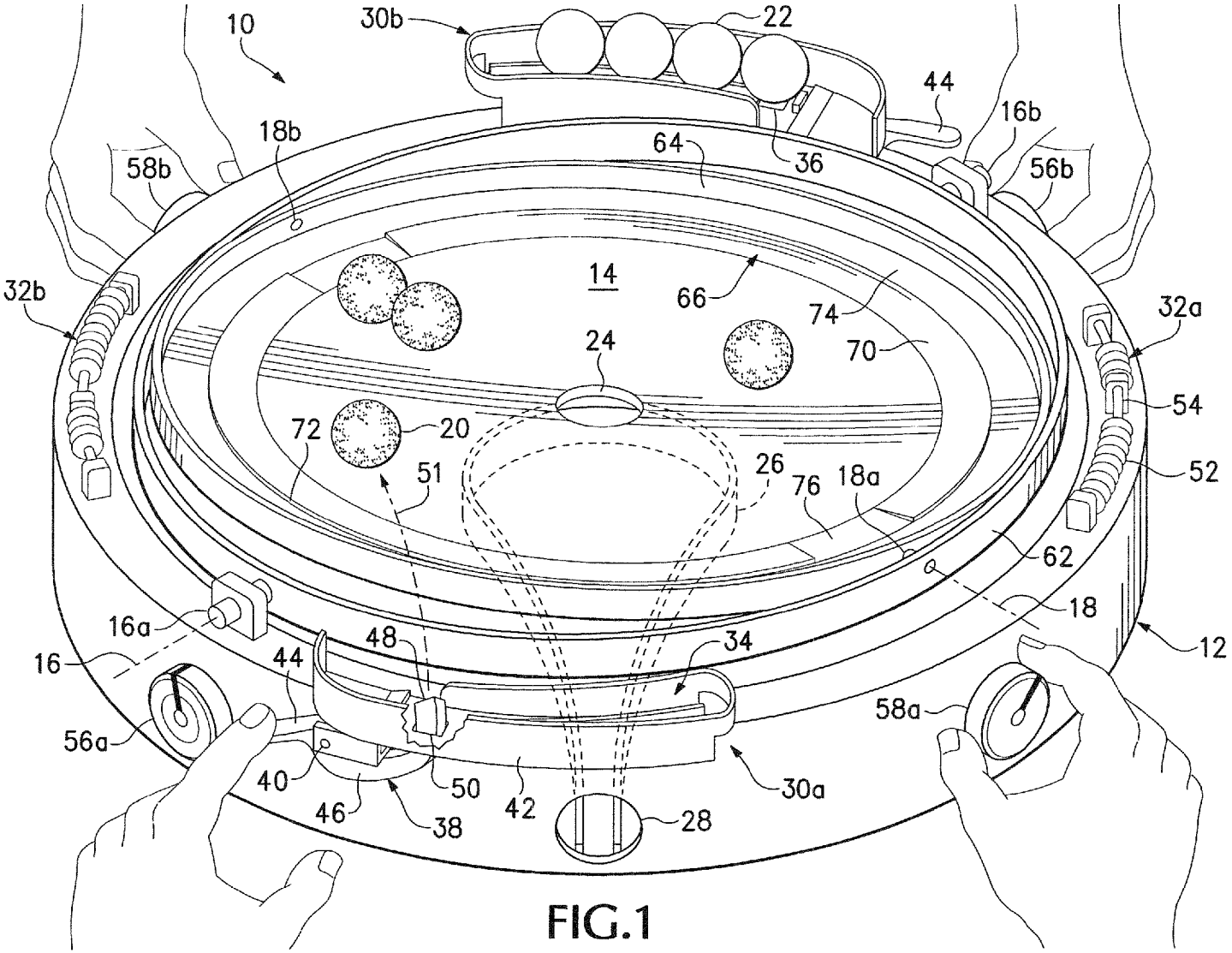
FIG. 1 is a perspective view of the head-to-head tilting surface game implemented according to a preferred embodiment of the invention.

FIG. 1 is a perspective view of the game 10. Game 10 is shown with a generally circular outer frame 12 defining a periphery within which a tiltable playing surface 14 is mounted, as via a set of outer pivot mounts 16*a* and 16*b* along a first axis 16, and a second set of inner pivot mounts 18*a* and 18*b* along a second axis 18. Playing surface 14 is tiltable in two orthogonal directions, as along orthogonal axes 16 and 18, to effect movement of playing pieces toward a goal area. Here, the playing pieces are first player balls 20 and second player balls 22 whose movement is directed along the playing surface toward a centrally located hole 24. Balls dropping into hole 24 are then directed by a ball return 26 to an exit aperture 28 formed through a wall of the outer frame 12.

In a two-player game, the first player balls 20 can be colored or patterned to be different from those balls 22 of the second player. Here, balls 20 have one color while balls 22 are a different color. Alternately, one set of balls may have a uniform color while another set has a colored stripe marked on their outer surface. In a four-player game, the balls 20, 22 can be marked to denote four different types—one for each of the players. Depending upon the rules of the game, a player wins when he or she is either the first player to direct all of their balls into the central hole 24, or alternately when all of the opposing players' balls have been "sunk" into the hole 24.

Outer frame 12 has mounted thereon two ball delivery systems 30*a*, 30*b*—one for each player—and score keeping means 32*a*, 32*b*.

Each ball delivery system includes a channel 34, coupled to a peripheral edge of the table frame 12, which slopes downward to a launching point 36. A mechanical arm 38 is pivot connected 40 to an underside of the body 42 framing the channel 34 and off-center to its center weight point so that, in a rested position, an actuator arm 44 angles upward at one end and a launching arm 46 angles downward. The launching arm 46 has a general C-shape and includes a sloping surface at its terminal end 48 angled toward the playing surface 14. A hole 50 is formed at a bottom portion of the channel at the launching point 36 and is sized to receive therethrough the sloped terminal end 48 of the launching arm 46.

In use, a player would tap downward on the actuator arm 44, thus causing the launching arm 46 to rotate upward around the pivot 40. The angled terminal end 48 of the launching arm then passes up through the hole 50 into the channel 34 and against an underside of a ball 20 resting there to thereby launch the ball upward and inward on a trajectory 51 toward a center of the playing surface 14. The trajectory 51 of the ball 20 from the launcher 30*a* preferably results in a landing within an outer portion 74 of the playing surface 14, however the game is not limited thereby. The terminal end 48 then returns back down through the hole 50 as the mechanical arm 38 returns to its resting position, with the actuator arm 44 up and the launching arm 46 down. The next ball then rolls down the channel 34 to the launching point 36 now vacated by the terminal end 48 of the launching arm.

The score keeping means 32*a*, 32*b* can be any means for keeping score. In the preferred embodiment as shown in FIG. 1, the score keeping means 32*a* include a plurality of beads 52 slidably mounted on a horizontal rod 54 for keeping track of both games won and score within the present game.

Also mounted on an outer wall of frame 12 are four actuators grouped into two pairs. A first pair of actuators 56*a*, 56*b* are coupled together and operably configured to tilt the table along axis 16. A second pair of actuators 58*a*, 58*b* are coupled together and operably configured to tilt the table along axis 18. Each actuator is coupled to the table through a mixer 60 (FIG. 2) to mechanically or electrically combine move signals from the actuators which are then imparted to the playing surface 14.

Players can actuate one of the first pair of controls and one of the second pair of controls to effect tilting of the playing surface in competition with an opposing player operating another of the first pair of controls and another of the second pair of controls. In a two-player game, actuators 56*a* and 58*a* are used by a first player to tilt the playing surface 14 of table 10 along axes 16 and 18, respectively. In a similar fashion, actuators 56*b* and 58*b* are used by a second player to tilt the playing surface 14 of table 10 along axes 16 and 18, respectively. As will be appreciated with reference to the description below, movement of one actuator is essentially independent of a paired actuator so that players may effect both offensive and defensive tilting signals through the mixer without relying on a strength contest with the opposing player.

Turning next to the playing surface 14 itself, tilting is accomplished in a preferred implementation through a series of nested rings coupled in a gimbled arrangement. The outer ring 62 is coupled to the stationary outer frame 12 of the game 10 via opposing pivots 16*a*, 16*b* aligned with pivot axis 16. Tilting of this ring—either left or right of axis 16—occurs by player operation of actuators 56*a* and 56*b*. In a preferred embodiment, actuators 56*a* and 56*b* are implemented in dials mounted on opposing sides of the game frame 12 along axis 16. Turning the dials cause, through means described below, the playing surface to tilt in the direction in which the dial is turned. In FIG. 1, for instance, turning the dial 56*a* clockwise will cause the left side of the table adjacent dial 58*b* to lift and the right side adjacent dial 58*a* to drop.

Similarly, rotating the dial 56*b* in the clockwise direction (from the perspective of player #2) will cause the opposite tilting effect. In this way, player #2 can counteract the tilting of player #1. Tilting direction is thus intuitive to rotation of the dials.

An inner ring 64 is coupled to outer ring 62 along pivot points 18*a*, 18*b* disposed along axis 18 where axis 18 is orthogonal to axis 16. Tilting of this ring—either left or right of axis 18—occurs by player operation of actuators 58*a* and 58*b*. In a preferred embodiment, actuators 58*a* and 58*b* are implemented in dials mounted on opposing sides of the game frame 12 along axis 18. Turning the dials cause, through means described below, the playing surface to tilt in the direction in which the dial is turned. In FIG. 1, for instance, turning the dial 58*a* clockwise will cause the side of the table to the left of the dial 58*a* to lift and the right side to drop—as is shown in FIG. 1. Similarly, rotating the dial 58*b* in the clockwise direction (from the perspective of player #2) will cause the opposite tilting effect. In this way, player #2 can counteract the tilting of player #1. Tilting along axis 18 (just as along orthogonal axis 16) is thus intuitive to rotation of the dials. Throughout the tilting process, the center of the table where hole 24 is located is maintained substantially at the same height.

Rings 62 and 64 are preferably positioned so that they extend above the playing surface 14. In this way, inner ring 64 presents a peripheral barrier to balls 20, 22 within the playing surface 14. Similarly, outer ring 62 presents a barrier to balls contained within the launchers 30*a*, 30*b* so that the balls must be launched up and over the ring 62 and into the playing area bounded by inner ring 64.

Figure 2:
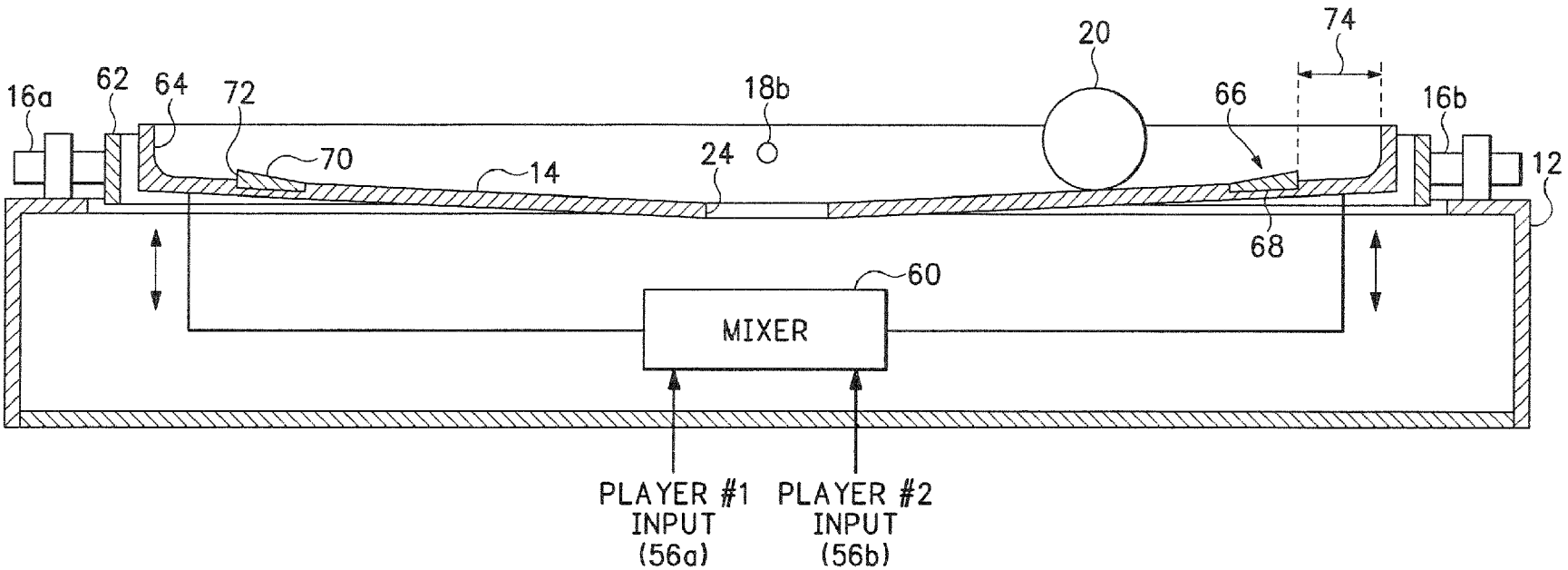
FIG. 2 is a schematic side elevation section view of the mechanism used for tilting the game of FIG. 1 according to a preferred embodiment of the invention.

FIG. 2 shows how tilting is effected generally through mixer 60. Player #1 provides a movement signal input, as through rotation of actuator dial 56*a*, and player #2 provides a respective move signal, as through rotation of actuator dial 56*b*. These signals are decomposed into vector signal inputs that have both a magnitude and direction. The mixer 60 then combines these signals to impart movement to the table in the direction and magnitude determined by an addition of the two input signals. If player #1 rotates dial 56*a* to effect tilting downward of the left side of inner ring 64 while player #2 rotates dial 56*b* to effect tilting upward of the same side of the ring, but player #1 rotates his dial more that player #2, then the magnitude of the player #1 signal is greater and the left side of ring 64 is moved downward (although to a lesser extent than player #1 intended).

Figure 5:
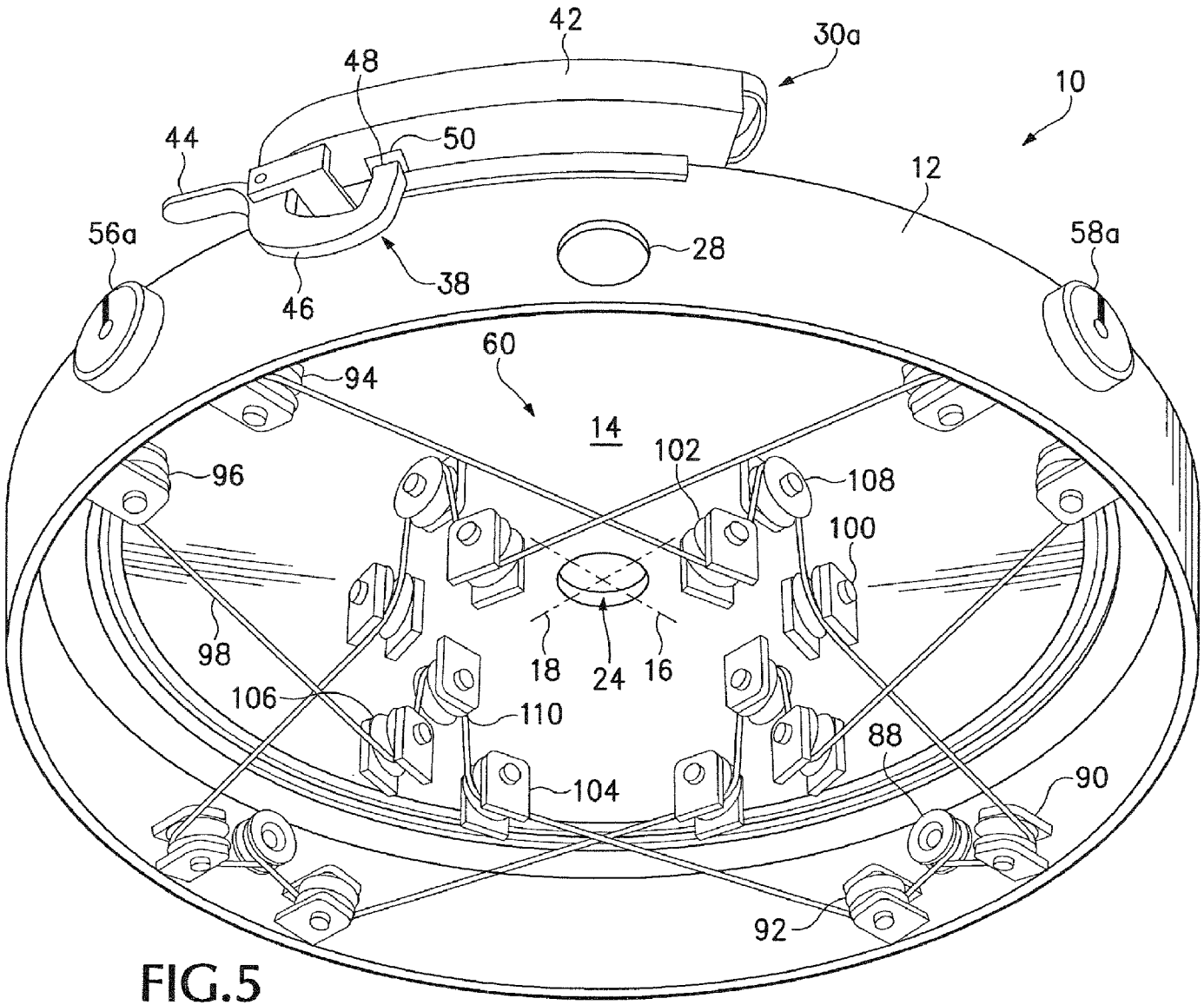
FIG. 5 is a perspective view of the underside of the game of FIG. 1, showing details of the tilting mechanism of FIG. 2, but implemented in a pulley arrangement according to a first embodiment of the invention.
Figure 7:
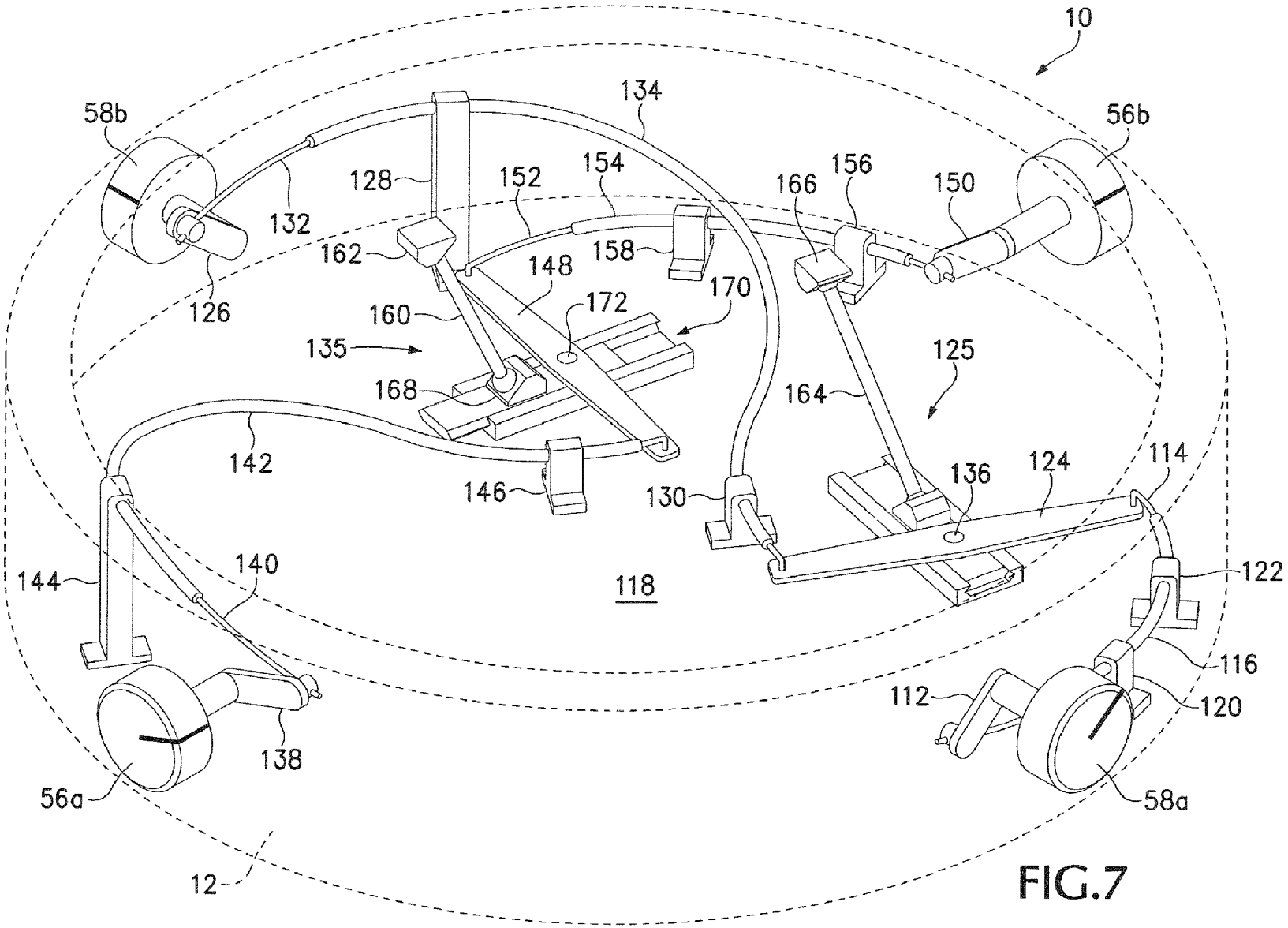
FIG. 7 is a perspective view of the underside of the game of FIG. 1, showing details of the tilting mechanism of FIG. 2, but implemented in a bell-crank arrangement according to a second embodiment of the invention.
Figure 8:
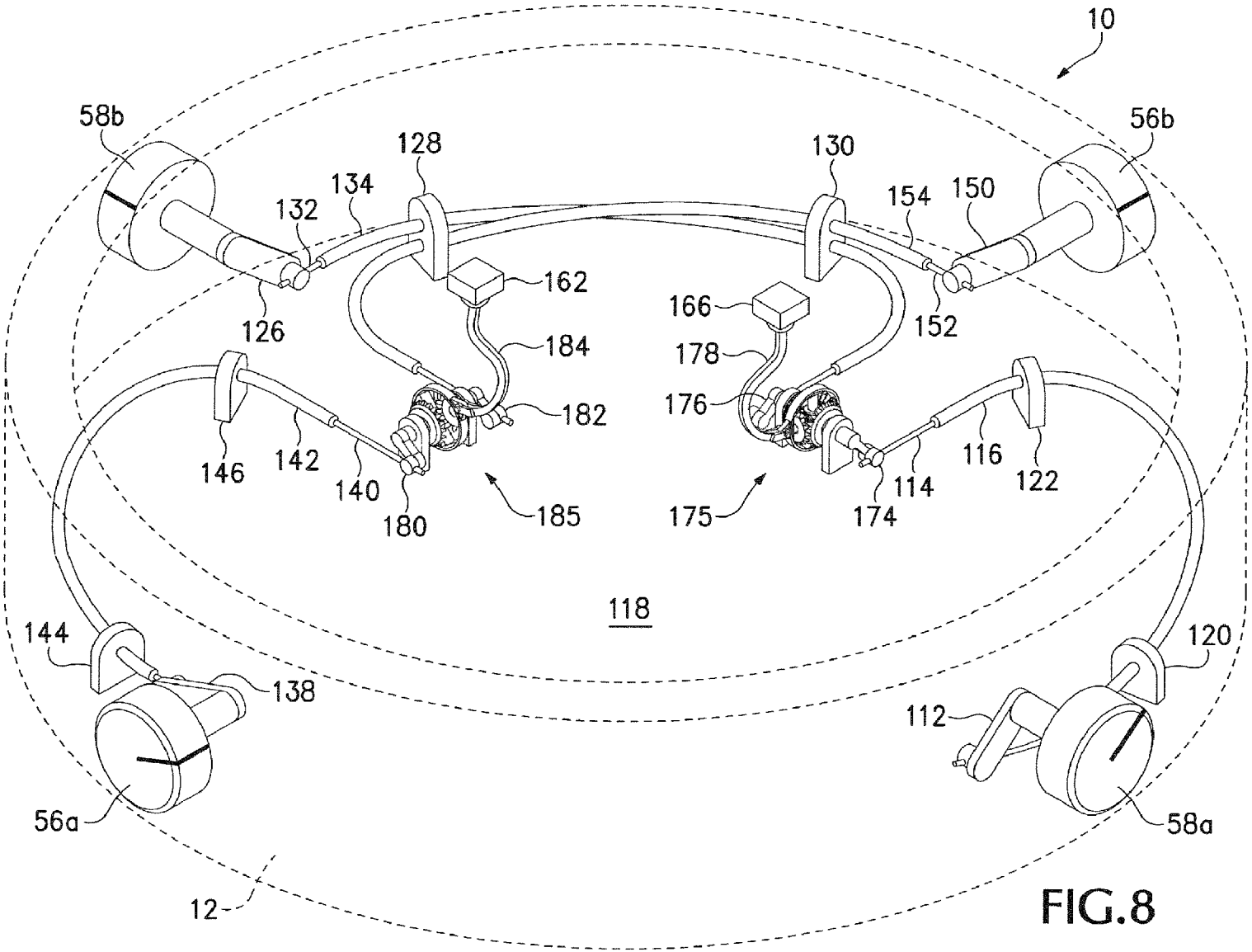
FIG. 8 is a perspective view of the underside of the game of FIG. 1, showing details of the tilting mechanism of FIG. 2, but implemented in a satellite bevel gear arrangement according to a third embodiment of the invention.

Mechanical movement of the table via the mixer can be accomplished by several embodiments detailed herein, including a pulley system shown in FIG. 5, a bell-crank arrangement shown in FIG. 7, and a satellite bevel gear system such as shown in FIG. 8. Electrical methods for mixing the signals is by using a potentiometer coupled to the actuators where movement of the dials sends different magnitude signals (around a set centerpoint) to an electrical mixer that then adds the signals from opposing players and imparts movement to the table. One knowledgeable in the art would recognize other methods for mixing and moving the tables, both mechanical and electrical, and the invention is not intended to be limited to the specific embodiments shown.

The playing surface 14, in a preferred embodiment, is configurable with various elements to change certain tactical elements of the game. In the embodiment shown in FIGS. 1 and 2, a configuration ring 66 is inserted within a groove 68 formed in the playing surface 14. Ring 66 includes a raised surface portion 70 along a majority of the arc of the ring that presents a blocking edge 72 to an outer portion 74 of the playing surface 14. The inward edge of the raised surface portion 70 is flush with the inner portion of the playing surface so that the top surface of portion 70 is downwardly sloped toward a center of the playing surface 14. One or more alleys 76 are formed within the ring 66 to allow a ball 20 to pass from an outer portion 74 of the playing surface to an inner portion. The strategy would be to therefore guide the balls 20 first entering the playing field, as by launching from launcher 30*a*, by tilting the table so that the balls pass through the alleys 76 from the outer portion 74 of the playing surface to the inner portion and thence to the central hole 24. In practice, the blocking edge 72 would be high enough to prevent a ball from passing over it. Also, an opponent's ball 22 can be guided from an inner portion of the playing surface 14 up and over the raised surface portion to the outer portion 74. The other player would then need to guide that ball back out through the alleys 76. Other configurations of ring 66 are contemplated, including a ring having no raised surfaces that sits flush within the groove 68 to present a unified concave or inwardly tilting surface to the playing surface 14.

FIG. 3 illustrates the effected tilt of the playing surface 14 in four exemplary scenarios. Rotations are illustrated by amount and direction. Move signals are illustrated in direction (either up or down) and magnitude (the length of the arrow) from the perspective of the player turning the dial. Thus, the effect of player #1 rotating his actuator dial clockwise would have the same effect as player #2 rotating his actuator dial counterclockwise. Also, because of perspective, player #1 clockwise rotation would cancel out player #2 clockwise rotation. The sum of the $1^{st}$ and $2^{nd}$ move vectors is illustrated again by the direction and magnitude of the arrow. Finally, the resulting tilt of the playing surface is illustrated compared to a dashed level line.

In scenario '1', player #1 turns dial 56*a* two complete counterclockwise rotations (720°) thus resulting in a large upward move vector imparted to mixer 60 while player #2 fails to turn dial 56*b* at all thus resulting in no move vector. Because player #2 did not move his or her dial, the sum of the two move vectors is simply the move vector from player #1. The resulting tilt is (from player #1's perspective) highly slanted upward from left to right.

In scenario '2', player #1 turns dial 56*a* one counterclockwise rotation (360°) thus resulting in a medium upward move vector imparted to mixer 60 while player #2 turns dial 56*b* one clockwise rotation (360°) thus also resulting in a medium upward move vector. The sum of these two vectors is the same as in scenario '1', where the resulting tilt is (from player #1's perspective) highly slanted upward from left to right.

In scenario '3', player #1 turns dial 56*a* one and a quarter clockwise rotations (450°) thus resulting a slightly more than medium upward move vector imparted to mixer 60. Player #2 moves his dial in the same fashion as player #1, thus resulting in an equal but opposite move vector. The sum of the two move vectors is zero, thus resulting in no net tilt to the playing surface 14.

In scenario '4', player #1 turns dial 56*a* three-quarters counterclockwise rotation (270°) thus resulting in a slightly less than medium upward move vector imparted to mixer 60. Player #2 moves his dial one and three-quarters counterclockwise rotation (630°), thus resulting in a large downward move vector. The sum of the two move vectors is a medium net downward effect (e.g. half the magnitude as in scenarios '1' and '2') so that the resulting tilt of playing surface 14 is downward from left to right.

Tilting is preferably accomplished through the following formula electrically or mechanically applied by the mixer(s) 60:

$$\text{Turn Angle } A + \text{Turn Angle } B = \text{constant} * \text{Tilt Angle } C \quad (1)$$

where the constant is around 1/20. The turn angles are judged from a single perspective (e.g. both from player #1, or both from player #2). If the angle is judged from the player perspective of the one turning the dial, the equation is subtractive instead of additive.

It should be noted that the magnitudes shown in FIG. 3 are purely illustrative and that other relationships between the amount of rotational of the actuator dial and the resulting tilt of the playing surface is contemplated. In a preferred embodiment of the invention, for instance, the rotation has been calibrated so that full tilt may be obtained by rotating the dial less than 360°, and preferably around 220°. Accordingly, full tilt may be obtained by player #1 rotating his dial in a counterclockwise direction by 110° and player #2 rotating his corresponding dial in a clockwise direction by 110°. Alternately, both player #1 and player #2 may continue to rotate their respective dials in a counterclockwise (or clockwise) direction for multiple revolutions with no net tilt of the playing surface.

Although the scenarios above result from movement of actuator dials 56*a* and 56*b*, one will appreciate that such scenarios also apply to movement of actuator dials 58*a* and 58*b* for tilting movement of the playing surface 14 along an orthogonal axis to the one shown in FIG. 3. Furthermore, vector summation can occur through a second mixer (as shown by the second set of pulleys in FIG. 5) or within the same mixer 60. Finally, combined movement of all actuators results in tilting in various directions, as can result in a vector addition between all movement vectors.

FIGS. 4A and 4B illustrate partial cutaway views of the two embodiments of playing pieces used on the playing surface 14.

In FIG. 4A, ball 20 includes a rigid and spherical outer shell 78, a solid fill 80, and a centrally located weighted core 82. Shell 78 and fill 80 can be formed of plastic such as ABS or polypropylene, while core 82 is preferably formed of denser material such as lead. The speed of ball 20 on the playing surface 14 has been found to increase as the weight of the ball increases. Thus, increasing the size of core 82 makes the game faster. Conversely, removing the lead core 82 and leaving the core space hollow would reduce the weight of the ball 20 and slow the game down. The center of gravity of ball 20 is dead center of the spherical outer shell 78

In FIG. 4B, ball 20*a* includes a rigid and spherical outer shell 78 with a weighted inner portion, here shown by ball-bearing 84, slidably retained within the shell 78. The weighted inner portion could also be sand or other materials. The resulting effect is that the weighted center of gravity of the playing piece is lower than and off-center to the spherical center 86 of the shell 78. Consequently, the speed of the playing pieces on the playing surface is reduced and the game slowed. It will be appreciated, therefore, that carefully selecting the ball size, weight, and respective center of gravity can affect the speed of the game.

Several different types of balls may be included within the game. For instance, a second ball 22*a* may have a second weight 84 that is slidaby retained within the spherical shell 78 where the second weight is different from the weight of the first ball. In this way the game can include balls moving at different speeds where certain balls may count for more points. Other types of balls and playing pieces are of course possible; for instance the balls can formed of a single, solid material.

FIG. 5 shows a perspective view of the underside of table 10, with the bottom and ball return 26 removed, and showing a first embodiment of the mixer 60. The mixer embodiment shown relies on a series of pulleys coupled between each pair of actuators via a fixed length cable. The embodiment shown also illustrates that mixer 60 actually includes two sets of pulleys—one for each tilting axis 16, 18. The embodiment can thus be considered to include two mixers rather than one. A description of one pulley set will now be described, with the same detail being equally applied to the other pulley set.

Actuator dials 56*a* and 56*b* are coupled to a first set of pulleys running beneath the playing surface 14 and within the boundaries of the game frame 12. Dial 56*b* (not shown in FIG. 5) is rotationally coupled to a central pulley 88 mounted on an inside surface of frame 12. Secondary pulleys 90, 92 are mounted on either side of central pulley 88 to the inside surface of frame 12. Spaced on the opposite wall of frame 12, secondary pulleys 94, 96 are mounted on either side of the central pulley (not shown) rotationally coupled with actuator dial 56*a*. A cord or cable 98, having a fixed length, is wrapped around the central pulleys 88 and about secondary pulleys 90, 92, 94, and 96 in a circuit as shown. The cable 98 is also coupled about interposed tilting pulleys, with tilting pulleys 100, 102, 104, and 106 fixed to a floor of the game 10, and tilting pulleys 108, 110 fixed to the underside of tilting surface 14 along tilting axis 18 with the central portion of the playing surface 14 (e.g. hole 24) spaced equidistantly between pulleys 108 and 110, A first set of tilting pulleys—comprising pulleys 100, 102, and 108—are mounted on one side axis 16 while another set—comprising pulleys 104, 106, and 110—are mounted on the other side of axis 16 an equidistant amount. The mixer/pulley system coupled to dials 58*a* and to 58*b* have a similar arrangement, with the pulleys coupled to the underside of the playing surface fixed along orthogonal tilting axis 16 and with the central portion of the playing surface (e.g. hole 24) also spaced equidistantly between those pulleys.

Tilting occurs by way of adjusting the slack between tilting pulleys 100, 102 and tilting pulley 108, and between tilting pulleys 104, 106 and tilting pulley 110. Since the cable 98 wrapping around all of the pulleys has a fixed length, rotating the actuator dials 56*a*, 56*b* so as to take slack from the pulley set including tilting pulley 110 would necessarily add slack to the opposing pulley set including tilting pulley 108. And because the tilting surface is mounted to pivots 16*a*, 16*b* (FIG. 1) along axis 16, the side of playing surface with tilting pulley 110 is pulled down about axis 16 while the side of playing surface with tilting pulley 108 is allowed to rise. That is, rotating dial 56*a* counterclockwise draws the cable 98 toward secondary pulley 96, thereby causing pulley 110 to be pulled down while pulley 108 goes up. The net effect is a tilting of the table along axis 16.

The amount by which the dials must be rotated to effect a certain angle of tilt can be adjusted by changing the diameter of the central pulleys 88. As pulley 88 is made larger, the dial can be turned in a smaller arc to take up the same amount of "slack" in the cable 98 (thereby transferring slack from one side of the mixer 60 to the other). As noted above, the diameter of the central pulley 88 is preferably selected to effect full tilt of the table by less than a full rotation of a single dial 56*b*.

Figure 6A:
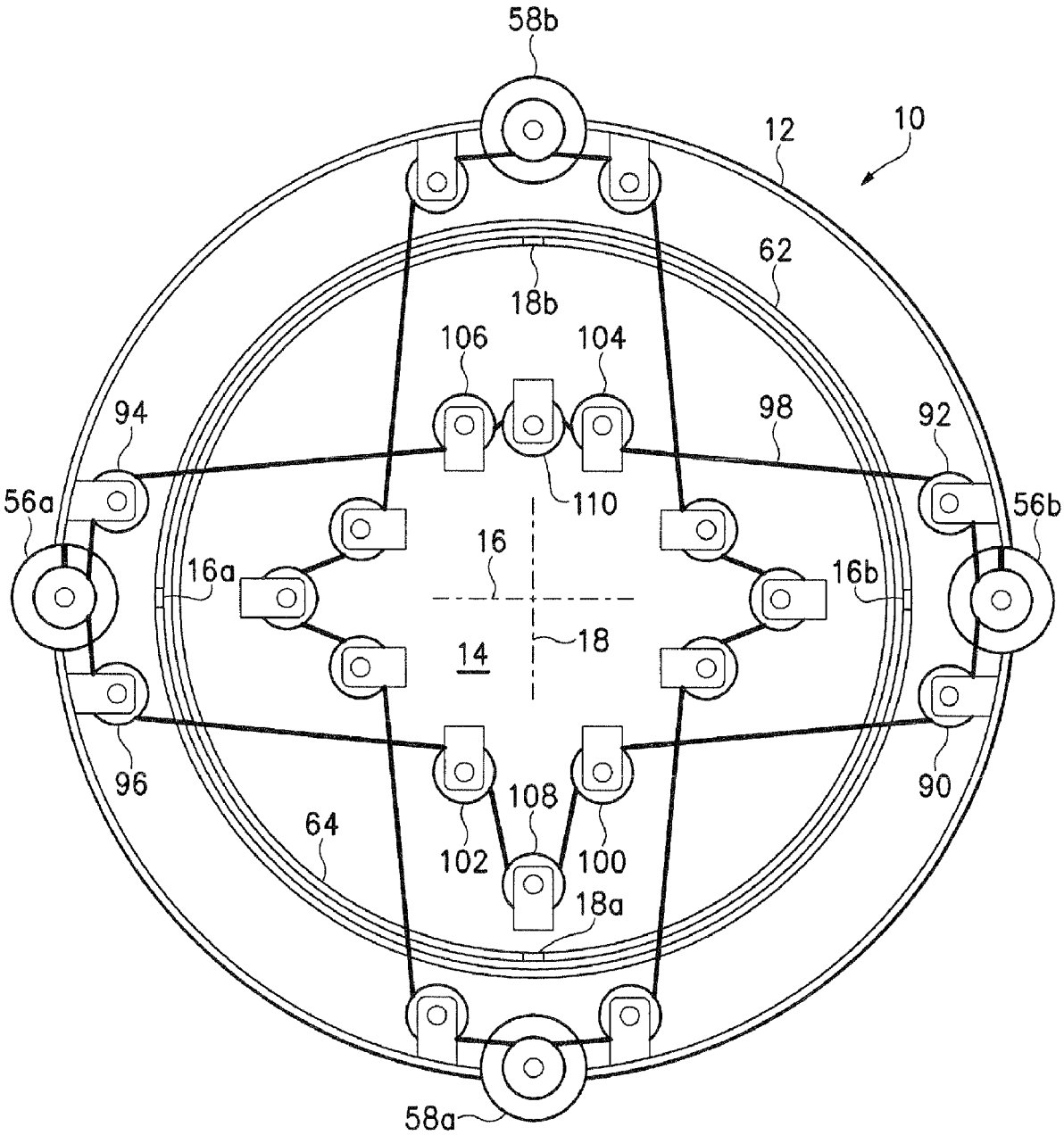
FIGS. 6A through 6C illustrate plan view schematics of the tilting mechanism of FIG. 5 showing tilt caused by rotation of actuators in an amount and direction shown in the table of FIG. 3.
Figure 6B:
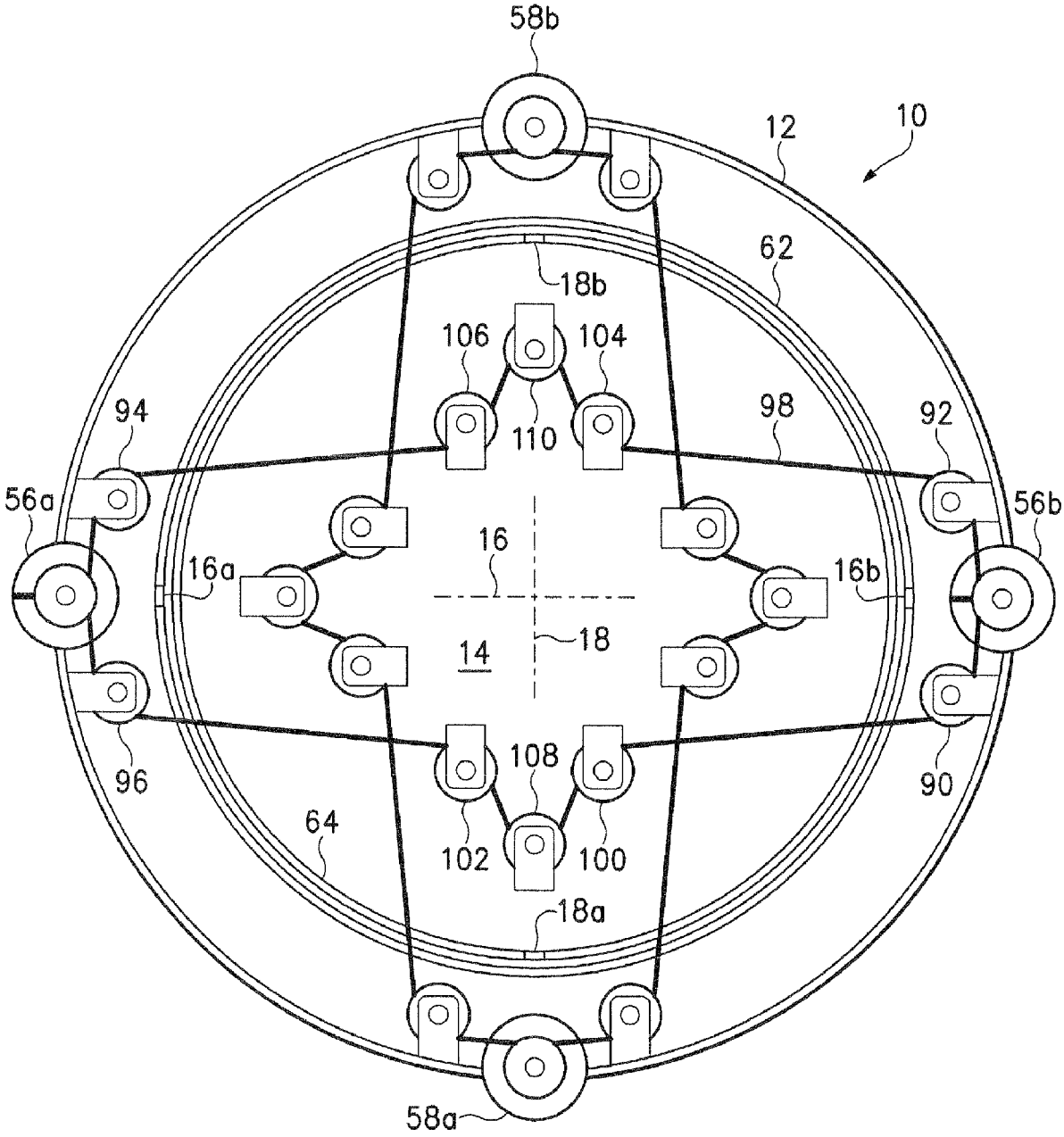
Figure 6C:
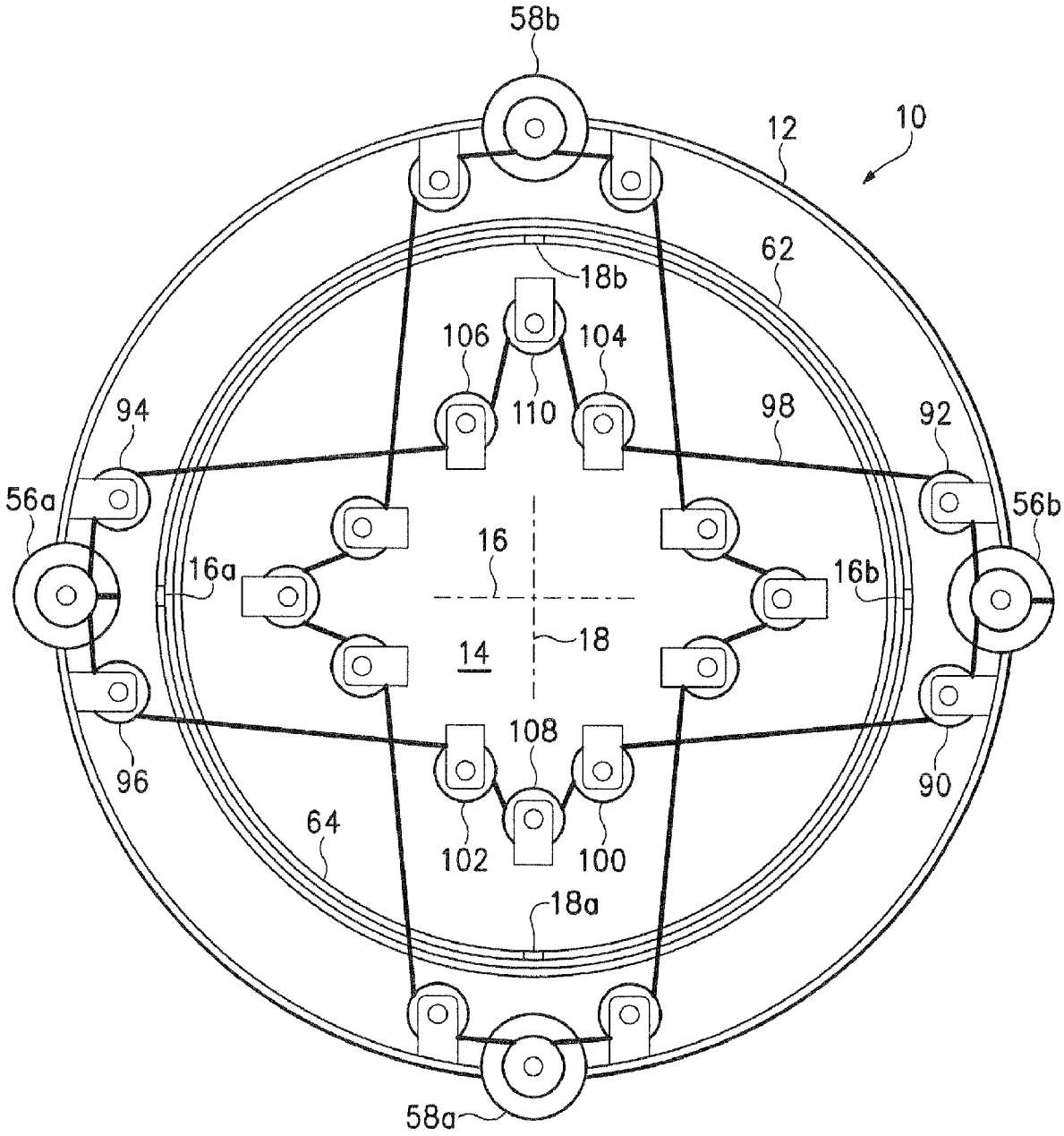

FIGS. 6A through 6C illustrate the net tilting effect on the pulleys of FIG. 5 using the scenarios of FIG. 3. The illustrations are somewhat schematic as the tilting pulleys have been flattened to show their respective distance apart in a plan view.

The movement of the pulley system of FIG. 5 will now be described with respect to the scenarios illustrated in FIG. 3.

FIG. 6A illustrates a pegging of one set of pulleys so that the playing surface is tilted as far as it can go in one direction. In scenario '1', dial 56*a* is rotated counterclockwise two full rotations, thus drawing pulley 110 in alignment with pulleys 104, 106. Pulley 108, attached to the underside of playing surface 14 along axis 18, is as spaced as possible from pulleys 100, 102. No further tilting of the table on axis 16 is possible. In scenario '2', dial 56*a* is rotated a single rotation counterclockwise while dial 56*b* is rotated a single rotation clockwise. The net effect is also drawing pulley 108 into alignment with pulleys 104, 106 thus preventing the table from tilting further.

FIG. 6B illustrates, as with scenario 3', defensive tilting where the net effect of two players' rotation of their respective dials 56*a* and 56*b* is no tilting of the table on axis 16. That is, all secondary pulley sets are spaced apart the same as all others, thus resulting in no net tilt of the table.

FIG. 6C illustrates, as with scenario '4', an intermediate scenario where both players rotate their respective dials but one player's rotation is greater and thus effects a particular tilt, although to a lesser magnitude than desired. Where dial 56*b* is rotated greater than dial 56*a*, and in a counteracting direction, then the net effect is a small spacing between pulley 108 and pulleys 100, 102; but a greater spacing between pulley 110 and pulleys 104, 106.

Although the remaining pulleys—associated with dials 58*a*, 58*b*—are not moved in the figures, one would understand that rotation of dials 58*a*, 58*b* would have a similar effect to these other pulleys. One also appreciates that rotation of dials 56*a* or 56*b* has no affect on the ability to tilt the playing surface using dials 58*a* and 58*b*. Furthermore, and with the exception that there is some tilting limit as when the tilting pulleys come in to alignment, rotation of one dial has no affect on the rotation of another dial. In this way, play of the game is balanced, controlled, and intuitive.

FIG. 7 illustrates a second embodiment (using a bell-crank mechanism) of the mechanical tilting mixer in perspective view with the remainder of the table 10 hidden. Just as with the first embodiment, tilting of the table is accomplished by rotating actuator dials 56*a*, 56*b*, 58*a*, and 58*b*. Each dial is coupled to a crank, such as crank arm 112, that attaches to one end of a fixed-length cable, such as cable 114. Cable 114 is retained within a sleeve 116, which itself is fixed to a bottom plate 118 of the game 10 via guides 120, 122. Rotating the dial 58*a* causes the crank arm 112 to similarly rotate and pull or push the cable 114 within the sleeve 116. Whereas one terminal end of the cable 114 is coupled to the crank arm 112, the other terminal end of the cable 114 is attached to one end of a pivot arm 124 on bell-crank assembly 125. When actuator dial 58*a* is rotated clockwise, the crank arm 112 is rotated similarly to thus pull the cable 114 within sleeve 116 and pull on the connected one end of pivot arm 124. Similarly, when dial 58*b* is rotated in a clockwise direction (from the perspective of player #2), crank arm 126 rotates away from guides 128, 130 so that the attached cable 132 slides backward within sleeve 134 and pulls on the connected other end of pivot arm 124. The net mechanical effect is that pivot arm rotates about pivot point 136 so that the bell crank assembly 125 does not move and the table does not tilt.

Referring next to the second bell-crank assembly 135, dial 56*a* is coupled to crank arm 138 which in turn is coupled to one end of cable 140. Cable 140 is slidingly received within sleeve 142 which is affixed to the table 10 via guides 144, 146. The other terminal end of cable 140 is coupled to one end of pivot arm 148. Dial 56*b* is similarly coupled to crank arm 150, cable 152, sleeve 154, and guides 156, 158.

One will appreciate that the bell-crank assembly is configured to allow maximum tilting with very little rotation of the dials. That is, maximum tilt is achieved by an approximate 90° rotation of the dials. Therefore, the players need not spin their dials endlessly to achieve tilt but can rock the dials back and forth within a 180° arc (e.g. 90° clockwise from the centerpoint, and 90° counterclockwise from the centerpoint—the centerpoint being noted by a marking on the dial being at 12 o'clock) to achieve full control over the tilt.

Each of the bell-crank assemblies, such as bell crank assembly 135, include a control arm 160 coupled at an upper end 162 to an underside of the playing surface 14 along axis 18. The control arm 164 of bell crank assembly 125 is coupled at an upper end 166 to the underside of the playing surface 14 along axis 16. The lower end 168 of control arm 160 is slidingly coupled within a slot 170 so that it can move back and forth within the slot in response to movement of pivot arm 148.

In FIG. 7, dial 56*a* is shown rotated 90° clockwise which dial 56*b* is shown rotated 90° counterclockwise. The resulting effect is that crank arm 138 pulls on cable 140 and a corresponding end of the pivot arm 148. Similarly, crank arm 150 pushes on cable 152 and the other corresponding end of pivot arm 148. Since both ends of the pivot arm 148 are moved in the same direction and by the same amount, the arm does not pivot about pivot point 172 but rather slides forward within slot 170 so that the control arm is raised into a more vertical position as shown. This causes the table side connected to control arm upper end 162 to rise, and the other end to fall (because upper end 166 does not move) thus creating a tilt downward toward dial 58*a*.

FIG. 8 illustrates a third embodiment (using satellite bevel gearing) of the mechanical mixer in perspective view with the remainder of the table hidden. Just as with the first and second embodiments, tilting of the table is accomplished by rotating actuator dials 56*a*, 56*b*, 58*a*, and 58*b*. Each dial is coupled to a crank, such as crank arm 112, that attaches to one end of a fixed-length cable, such as cable 114. Cable 114 is retained within a sleeve 116, which itself is fixed to a bottom plate 118 of the game 10 via guides 120, 122. Rotating the dial 58*a* causes the crank arm 112 to similarly rotate and pull or push the cable 114 within the sleeve 116. Whereas one terminal end of the cable 114 is coupled to the crank arm 112, the other terminal end of the cable 114 is attached to a first rotating arm 174 of bevel gear assembly 175. When actuator dial 58*a* is rotated clockwise, the crank arm 112 is rotated similarly to thus pull the cable 114 within sleeve 116 and push on rotating arm 174 to thus rotate it clockwise. Similarly, when dial 58*b* is rotated in a clockwise direction (from the perspective of player #2), crank arm 126 rotates toward guides 128, 130 so that the attached cable 132 slides forward within sleeve 134 and pushes on the connected other end of second rotating arm 176. The net mechanical effect is that the bevel gears (explained below with reference to FIG. 9) within assembly 175 rotate in opposite directions so that the net effect on control arm 178 is zero—that is, control 178 does not move and the playing surface is not tilted along axis 18.

Referring next to the second bevel gear assembly 185, dial 56*a* is coupled to crank arm 138 which in turn is coupled to one end of cable 140. Cable 140 is slidingly received within sleeve 142 which is affixed to the table 10 via guides 144, 146. The other terminal end of cable 140 is coupled to one end of rotating arm 180. Dial 56*b* is similarly coupled to crank arm 150, cable 152, sleeve 154, guides 156, 158, and rotating arm 182.

Figure 9:
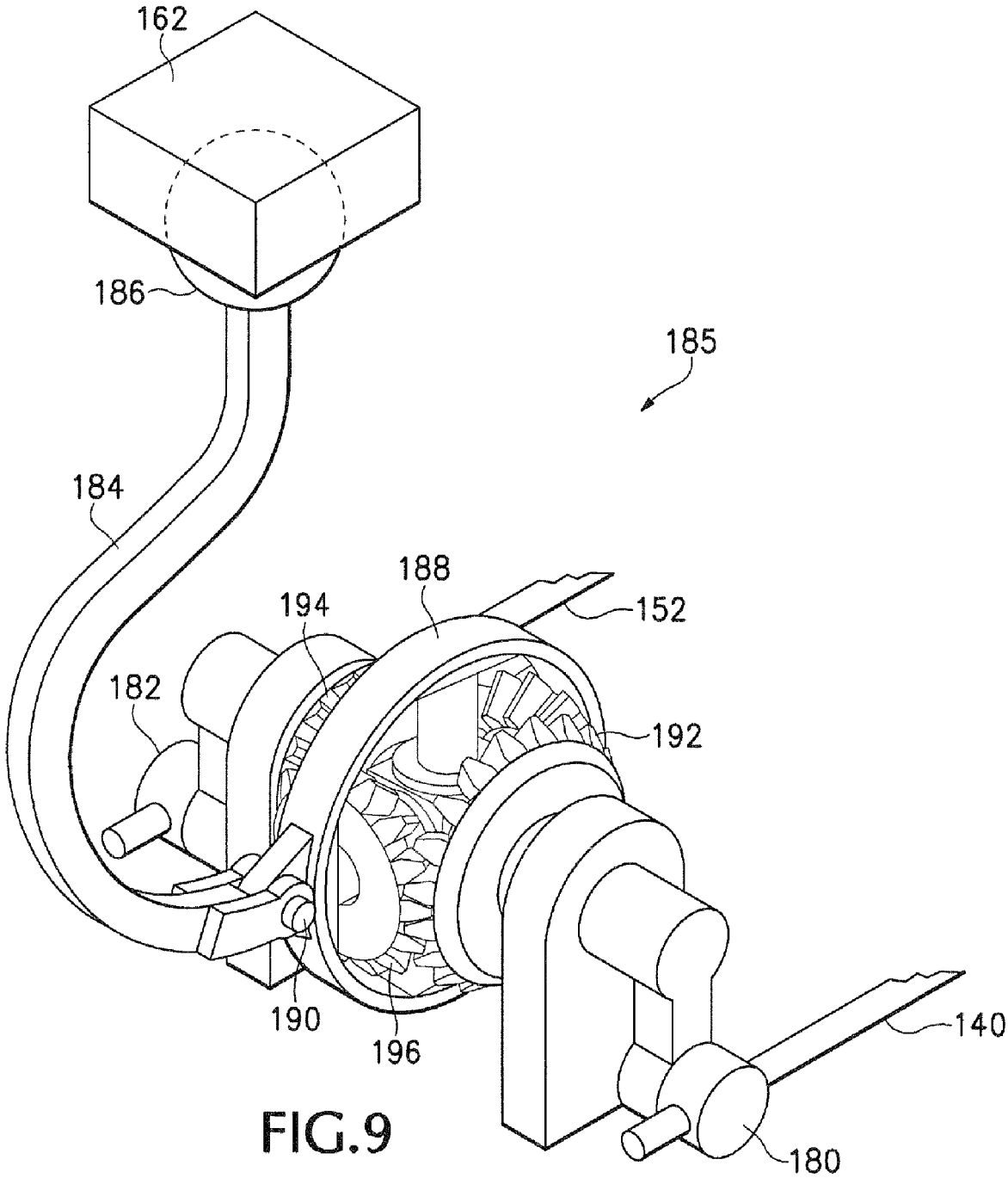
FIG. 9 is a magnified perspective view of the satellite bevel gear of FIG. 8.

Turning also to FIG. 9, showing a magnified view of bevel gear assembly 185, each of the bevel gear assemblies, such as gear assembly 185, include a control arm 184 coupled at an upper end 162 to an underside of the playing surface 14 along axis 18, as via a ball joint 186. Likewise, the control arm 178 of bevel gear assembly 175 is coupled at an upper end 166 to the underside of the playing surface 14 along axis 16. The lower end of control arm 184 is coupled to the housing 188 of assembly 185 via pivot 190. When the housing 188 is rotated by action of the gears within the housing, the control 184 is likewise lifted upward or pulled downward. The control arm 184 preferably has the shape of an inverted question mark so that it can fold over the bevel gear housing 188 when the housing is rotated and the upper end pulled downward. The housing 188 includes a pair of inwardly facing bevel gears 192, 194 with a satellite bevel gear 196 interposed between them. Bevel gear 192 is adapted to be driven by rotating arm 180, which in turn is driven by the rotation of actuator dial 56*a*. Bevel gear 194 is adapted to be driven by rotating arm 182, which in turn is driven by the rotation of actuator dial 56*b*. As bevel gear assembly 175 operates in a similar fashion with respect to actuator dials 58*a* and 58*b*, further description would be redundant and is thus deemed not necessary.

As with the bell-crank embodiment of FIG. 7, the bevel gear arrangement of FIGS. 8 and 9 require very little movement of the dial to effect tilting of the table.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A head-to-head tilting surface game, comprising:

a playing surface tiltable in two orthogonal directions to effect movement of playing pieces toward a goal area located on the playing surface;

a first set of controls, coupled together and configured to tilt the playing surface along a first of the two orthogonal directions; and a second set of controls, coupled together and configured to tilt the playing surface along a second of the two orthogonal directions, wherein players of the game can actuate one of the first set of controls and one of the second set of controls to effect tilting of the playing surface in competition with an opposing player operating another of the first set of controls and another of the second set of controls.

2. The head-to-head tilting surface game of claim 1, wherein the two orthogonal directions occurs along two orthogonal axes.

3. The head-to-head tilting surface game of claim 1, wherein the first set of controls includes two actuators coupled to a first mixer for mixing inputs from the actuators and imparting the result to the playing surface.

4. The head-to-head tilting surface game of claim 3, wherein the playing surface has a slightly concave shape with a lower portion defined at the goal area located centrally on the playing surface and at the intersection of the two orthogonal axes.

5. The head-to-head tilting surface game of claim 3, wherein at least one of the playing pieces comprise:

an enclosed spherical shell; and a weight slidably retained within the spherical shell so that the weighted center of the playing piece is lower than and off-center to a spherical center of the shell.

6. The head-to-head tilting surface game of claim 5, wherein another of the playing pieces comprise:

an enclosed spherical shell; and a second weight slidably retained within the spherical shell so that the weighted center of the playing piece is off-center to a spherical center of the shell, said second weight being different from the weight of the at least one of the playing pieces.

7. The head-to-head tilting surface game of claim 3, wherein the first set of controls are coupled together to allow independent movement of each of the first set of controls, and the second set of controls are coupled together to allow independent movement of each of the second set of controls.

8. The head-to-head tilting surface game of claim 7, wherein the first mixer includes a potentiometer configured to sum move signals of the first pair of controls.

9. The game of claim 1, wherein the first mixer includes a bell crank configured to mix the move signals from the first pair of controls.

10. A head-to-head tilting surface game, comprising:

a playing surface tiltable along two orthogonal axes configured to support moving playing pieces thereon, said playing surface having a goal area;

a first pair of controls disposed adjacent opposite peripheral edges of the playing surface along a first of the two orthogonal axes, each of said first pair of controls independently actuatable to result in a respective move signal; and a first mixer coupled between the first pair of controls and tilting surface to combine move signals from respective controls into a first axis tilt response and impart said first axis tilt response to the playing surface, whereby the playing pieces supported on the playing surface move responsive to the first axis tilt response imparted to the playing surface so that the playing pieces can be moved toward the goal area.

11. The game of claim 10, wherein the goal area is located centrally of the playing surface and at the intersection of the two orthogonal axes on which the playing surface is tiltable.

12. The game of claim 10, further including:

a second set of controls disposed adjacent opposite peripheral edges of the playing surface along a second of the two orthogonal axes; and a second mixer coupled between the second set of controls and tilting surface to combine move signals from respective controls into a second axis tilt response and impart said second axis tilt response to the playing surface, whereby the playing pieces supported on the playing surface move responsive to the first axis tilt response and the second axis tilt response imparted to the playing surface so that the playing pieces can be moved toward the goal area.

13. The game of claim 12, wherein at least one of the playing pieces comprise:

an enclosed spherical shell; and a weight slidably retained within the spherical shell so that the weighted center of the playing piece is lower than and off-center to a spherical center of the shell.

14. The game of claim 10, wherein the first pair of controls include a first player dial and a second player dial disposed adjacent opposite peripheral edges of the playing surface, each of said first and second player dials being rotatable about respective axis wherein the amount of rotation is proportional to a magnitude of respective move signals of the controls.

15. The game of claim 14, wherein the first mixer includes:

first axis control pulley 'a' coupled to an underside of the playing surface along a second tilting axis;

a first axis control pulley 'b' coupled to an underside of the playing surface along the second tilting axis, and on an opposite side of a central portion of the playing surface to the first axis control pulley 'a'; and a cable of a fixed length coupling the first and second player dials and first axis control pulleys 'a' and 'b' in a circuit, wherein turning the first player dial in a first direction shortens the length of the cable between the first player dial and first axis control pulley 'a', and lengthens the length of the cable between the first player dial and the first axis control pulley 'b' to thereby lower the playing surface at control pulley 'a' and raise the playing surface at control pulley 'b' and to thereby effect a tilting of the table along a first tilting axis orthogonal to the second tilting axis.

16. The game of claim 10, further including:

a second set of controls disposed adjacent opposite peripheral edges of the playing surface along a second of the two orthogonal axes; and a second mixer coupled between the second set of controls and the tilting surface to combine move signals from respective controls into a second axis tilt response and impart said second axis tilt response to the playing surface, whereby the playing pieces supported on the playing surface move responsive to the first axis tilt response and the second axis tilt response imparted to the playing surface so that the playing pieces can be moved toward the goal area, wherein the first mixer includes:

a first axis control pulley 'a' coupled to an underside of the playing surface along a second tilting axis;

a first axis control pulley 'b' coupled to an underside of the playing surface along the second tilting axis, and on an opposite side of a central portion of the playing surface to the first axis control pulley 'a'; and a first cable of a fixed length coupling the first pair of controls and first axis control pulley 'a' and 'b' in a circuit, wherein turning a first one of the first pair of controls in a first direction shortens the length of the first cable between the first one of the first pair of controls and first axis control pulley 'a', and lengthens the length of the first cable between a first one of the first pair of controls and the first axis control pulley 'b' to thereby lower the playing surface at control pulley 'a' and raise the playing surface at control pulley 'b' to thereby effect a tilting of the table along a first tilting axis orthogonal to the second tilting axis, and wherein the second mixer includes:

a second axis control pulley 'a' coupled to an underside of the playing surface along the first tilting axis;

a second axis control pulley 'b' coupled to an underside of the playing surface along the first tilting axis, and on an opposite side of a central portion of the playing surface to the second axis control pulley 'a'; and a second cable of a fixed length coupling the second pair of controls and second axis control pulley 'a' and 'b' in a circuit, wherein turning the second player handle in a first direction shortens the length of the second cable between a first control of the first pair of controls and first axis control pulley 'a', and lengthens the length of the second cable between a second one of the first pair of controls and the first axis control pulley 'b' to thereby lower the playing surface at control pulley 'a' and raise the playing surface at control pulley 'b' to thereby effect a tilting of the table along a first tilting axis orthogonal to the second tilting axis.

17. The game of claim 10, wherein the first mixer includes a potentiometer configured to sum the move signals of the first pair of controls.

18. The game of claim 10, wherein the first mixer includes a gearbox configured to mix the move signals from the first pair of controls.

19. The game of claim 18, wherein the gearbox includes:

bevel gears facing each other with each gear being driven by a respective one of the first pair of controls; and a satellite bevel gear interposed between the bevel gears.

20. The game of claim 10, wherein the first mixer includes a bell crank configured to mix the move signals from the first pair of controls.

21. The game of claim 20, further including:

push rod cables coupled at first ends to respective ones of the first pair of controls and at second ends to respective ends of the bell crank;

a slot slidingly receiving the bell crank, wherein the bell crank rotates within the slot when the move signals from the first pair of controls are of equal magnitude but opposite, and where the bell crank slides in the slot when a sum of move signals from the first pair of controls cause a non-zero value;

a coupling between the bell crank and an underside of the playing surface along the second axis to effect tilting of the table on the first axis.

22. A method for tilting the playing surface of a game to influence movement of playing pieces on the playing surface, the method comprising:

placing moveable playing pieces on a playing surface;

receiving movement from a first actuator resulting in a first vector move signal;

receiving movement from a second actuator resulting in a second vector move signal;

summing the first and second vectors through a mixing unit; and imparting tilting movement to the playing surface in a magnitude proportional to the summation of the first and second vectors.

23. The method of claim 22, further including:

receiving movement from a third actuator resulting in a third vector move signal;

receiving movement from a fourth actuator resulting in a fourth vector move signal;

summing the third and fourth vectors through a second mixing unit; and imparting tilting movement to the playing surface in a magnitude proportional to the summation of the third and fourth vectors and in a direction orthogonal to the tilting movement imparted to the playing surface by the first and second vectors.

24. The method of claim 22, wherein the first and second vector move signals are based on the amount and direction of rotations of the first and second actuators with clockwise rotation of the first actuator canceling out clockwise rotation of the second actuator, and counterclockwise rotation of the first actuator canceling out counterclockwise rotation of the second actuator.

25. The method of claim 24, further including the step of raising a first end and lowering an opposed second end of the playing surface responsive to rotation of the first actuator in a clockwise direction, and lowering the first end and raising the opposed second end responsive to rotation of the first actuator in a counterclockwise rotation.

26. The method of claim 24, further including the step of allowing the playing pieces to move toward a goal area located centrally on the playing surface responsive to tilting movement imparted to the playing surface.

27. A game comprising:

a playing surface over which one or more generally spherical elements are adapted to roll;

a raised peripheral edge bounding said playing surface;

a central zone within the playing surface serving as a goal to which the spherical elements are adapted to be guided during play of the game;

a first set of two opposing actuators in common communication with a first mixer configured to tilt the playing surface along a first axis passing through a center of the playing surface; and a second set of two opposing actuators in common communication with a second mixer, independent of the first mixer, configured to tilt the playing surface along a second axis passing through a center of the playing surface, said second axis being orthogonal to the first, wherein each of the actuators can be used to oppose tilting caused by an opposing actuator within the same set.

28. The game of claim 27, wherein the first and second mixer are first and second pulley systems, respectively, the first mixer being coupled between the first set of two opposing actuators and the playing surface, and the second mixer being coupled between the second set of two opposing actuators and the playing surface.

29. The game of claim 27, further including a stationary frame and a peripheral support, the peripheral Support coupled to the playing surface along the first axis, and the peripheral support coupled to the stationary frame along the second axis, whereby the playing surface is suspended from a surface supporting the stationary frame.

* * * * *